US006089217A

United States Patent [19]

Paulson et al.

[11] Patent Number: 6,089,217

[45] Date of Patent: Jul. 18, 2000

[54] BALL THROWING MACHINE WITH ADJUSTABLE TRIPOD LEG

[75] Inventors: Kerry K. Paulson, Sherwood; James A Kerr, Hillsboro, both of Oreg.; Thomas O. Pearson, Reedsville, Pa.; Terry L. Haile, Otis Orchards, Wash.

[73] Assignee: The Jugs Company, Tualatin, Oreg.

[21] Appl. No.: 09/234,031

[22] Filed: Jan. 19, 1999

[51] Int. Cl.[7] ..... F41B 4/00

[52] U.S. Cl. ..... 124/78; 124/6; 124/56; 124/80

[58] Field of Search ..... 124/1, 6, 56, 78, 124/80

[56] References Cited

U.S. PATENT DOCUMENTS

| | | | |
|---|---|---|---|
| 1,611,814 | 12/1926 | Butler | 124/78 |
| 2,994,313 | 8/1961 | Grahn | 124/6 |
| 3,538,900 | 11/1970 | Samuels | 124/78 |
| 4,026,261 | 5/1977 | Paulson et al. | 124/78 |
| 4,197,827 | 4/1980 | Smith | 124/78 |
| 4,760,835 | 8/1988 | Paulson et al. | 124/78 |
| 5,421,313 | 6/1995 | Strayer | 124/1 |

FOREIGN PATENT DOCUMENTS

| | | | |
|---|---|---|---|
| 859925 | 1/1941 | France | 124/6 |

*Primary Examiner*—John A. Ricci
*Attorney, Agent, or Firm*—Olson & Olson

[57] ABSTRACT

A ball throwing machine which includes a tripod leg support is provided with the rearwardly positioned leg formed as a pair of telescopic sections. Rack and pinion components are mounted one on each leg section and the pinion is operated by a crank to effect lengthening or shortening the telescopic sections, to effect an incremental change in the trajectory of a ball thrown by the machine.

5 Claims, 3 Drawing Sheets

BALL THROWING MACHINE WITH ADJUSTABLE TRIPOD LEG

BACKGROUND OF THE INVENTION

This invention relates to ball throwing machines, and more particularly to a ball throwing device provided with an adjustable tripod support.

Many ball throwing machines are provided with tripod supports. Examples are disclosed in U.S. Pat. Nos. 3,774,584; 4,193,591; 4,760,835; and 5,437,261 all of which have common ownership with this invention. However, none has a tripod provided with an adjustable leg for making incremental changes in the vertical trajectory of a ball thrown by the machine.

SUMMARY OF THE INVENTION

This invention provides a ball throwing machine with a tripod support which includes a leg that is capable of being adjustable in length in small increments to effect small changes in the vertical trajectory of a ball thrown by the machine.

It is the principal objective of this invention to provide a ball throwing machine of the class described that overcomes the aforementioned limitations of prior ball throwing machines.

Another objective of this invention is the provision of a ball throwing machine of the class described in which the rear leg of a tripod support is adjustable incrementally to effect fine adjustment of the trajectory of a ball thrown by the machine.

Still another objective of this invention is to provide a ball throwing machine of the class described in which the usual trajectory adjusting mechanism is supplemented with a longitudinally adjustable leg of the tripod support.

A further objective of this invention is the provision of a ball throwing machine of the class described which is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
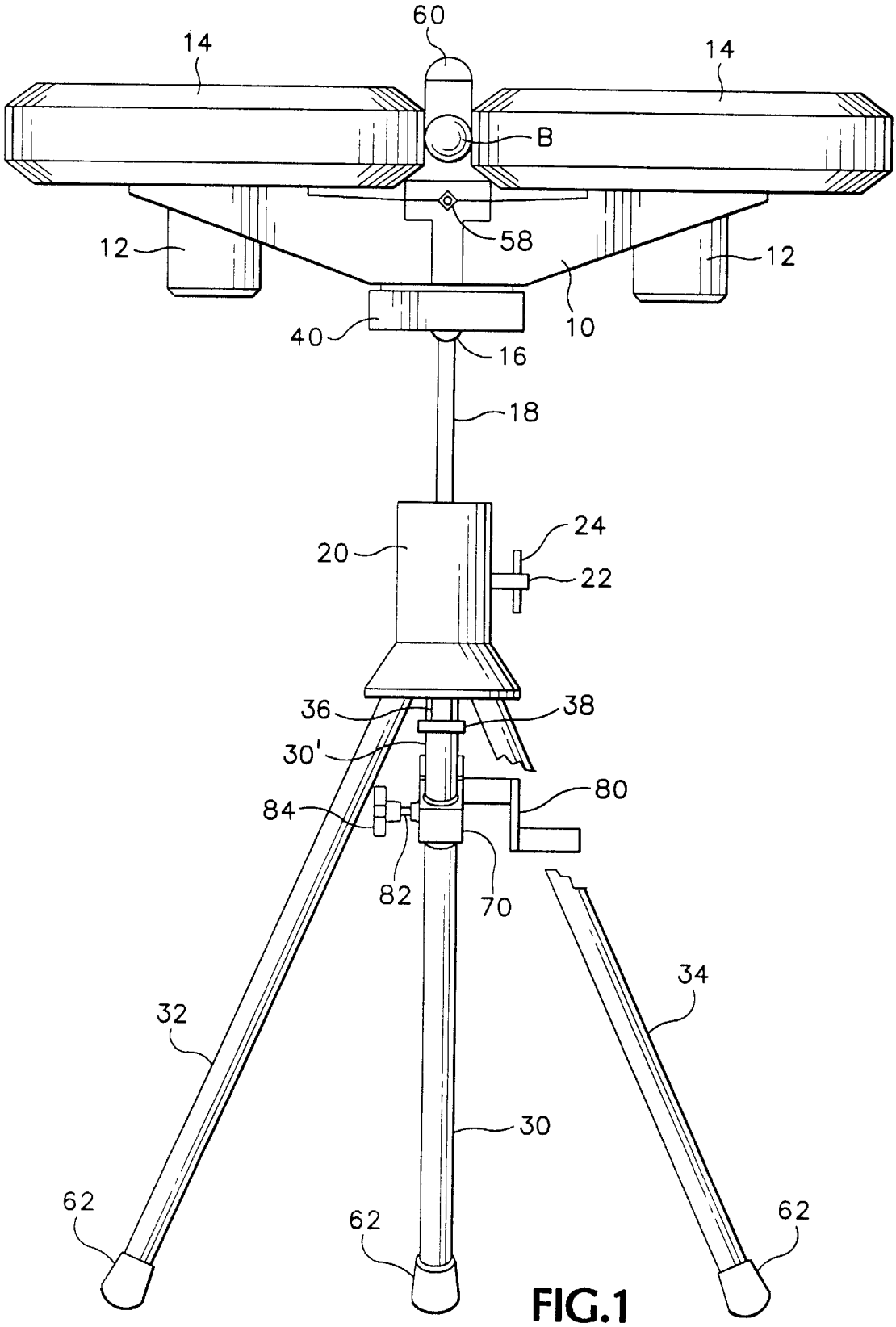
FIG. 1 is a front elevation of a ball throwing machine embodying the features of this invention, a portion being broken away to disclose structural details.

The embodiment of ball throwing device of this invention illustrated in the drawings is described in detail in U.S. Pat. No. 4,760,835 aforesaid. It includes a laterally elongated base member 10 supporting electric motors 12 which, in turn, support wheels mounting pneumatic tires 14. The electric motors drive the wheels in opposite direction of rotation and in a substantially common plane P.

The spacing between the confronting surfaces of the tires 14 is slightly less than the diameter of a ball B to be thrown. Accordingly, the ball is gripped between the rotating wheels and ejected forwardly therefrom.

The drive motors preferably are of the variable speed type in order to accommodate adjustment of the rotational speed of each wheel independently of the other.

The base member 10 is supported in a balanced condition by a universal pivot ball 16 mounted on the top end of an obliquely bent support arm 18. The lower end of the support arm has an enlarged cylindrical pivot contained rotatably in a bearing socket in the top of a base support 20.

The bent support arm is secured in either of two positions 180° apart by means of a lock screw 22 provided with a T-handle 24 to facilitate turning.

The lower end of the base support is flared outwardly and provided with three leg sockets 26 spaced 120° apart and diverging downwardly. The hollow center of the lower end of the base support receives a clamp member 28 of truncated conical shape, configured for clamping the upper ends of three support legs 30, 32, and 34. This clamping is effected by a clamp screw 36 having a reduced diameter inner section threaded for the reception in a threaded bore in the base support 20. A shoulder at the juncture of the clamp screw 36 and inner section abuts the lower end of the clamp member 28 to move the latter upward toward the base support 20, whereby to clamp the legs securely but removably to the base support. The clamp screw 36 is turned by means of a T-handle 38.

A pivot clamp member 40 is provided adjacent its forward end with a socket for the pivot ball 16. The front end of the pivot clamp member is connected adjustably to the forward, central portion of the base member 10. The rearward end of the pivot clamp member mounts the forward side of control box 42 which contains the electrical control unit for varying the speeds of rotations of the tires 14. For this purpose the electrical control unit includes potentiometers having control knobs 44 disposed at the top of the control box.

The rear side of the control box supports the vertical section 46 of a clamp bar. The horizontal section 48 of the clamp bar is provided with a threaded opening for receiving the reduced diameter threaded shank 50 of a clamp screw 52. The upper end of the clamp screw is provided with a hand knob 54 to facilitate its manipulation.

The threaded shank 50 extends freely through an opening at the juncture of the cross bar 56 of a T-handle the leg 58 of which extends forwardly for attachment to the base member 10. By rotating the clamp screw 52 to move it into or out of the horizontal section 48, the rearward end of clamp member 28 and leg 58 are moved toward or away from each other to clamp or release the base member 10 and clamp member 28 to or from the pivot ball 16. This allows readjustment of the rotational plane P of the ball projecting tires 14 by hand manipulation of the T-handle cross bar 56.

The base 10 mounts a ball feeder 60 the structure of which is described in detail in U.S. Pat. No. 4,760,835 aforesaid.

Figure 2:
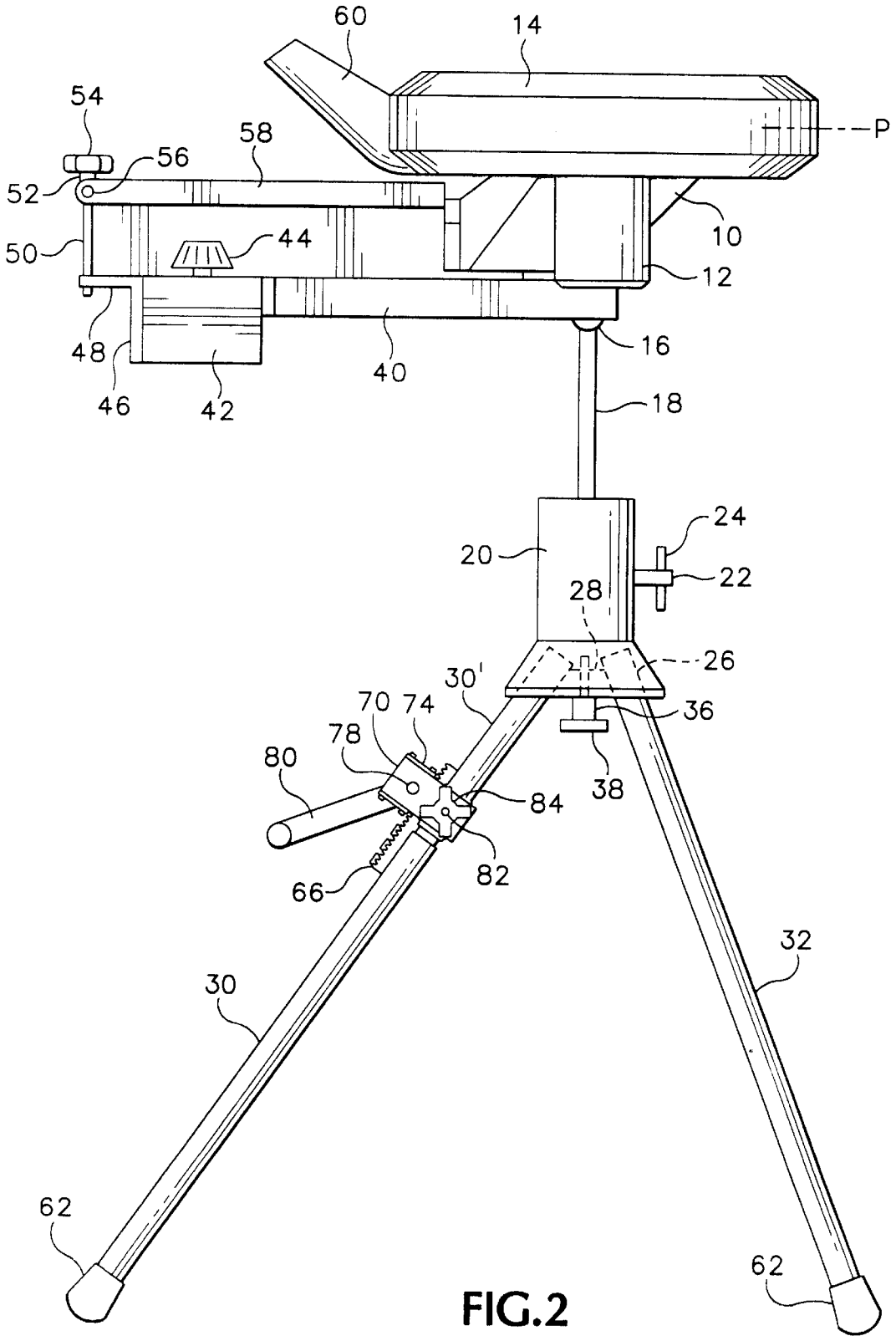
FIG. 2 is a side elevation as viewed from the left in FIG. 1.
Figure 3:
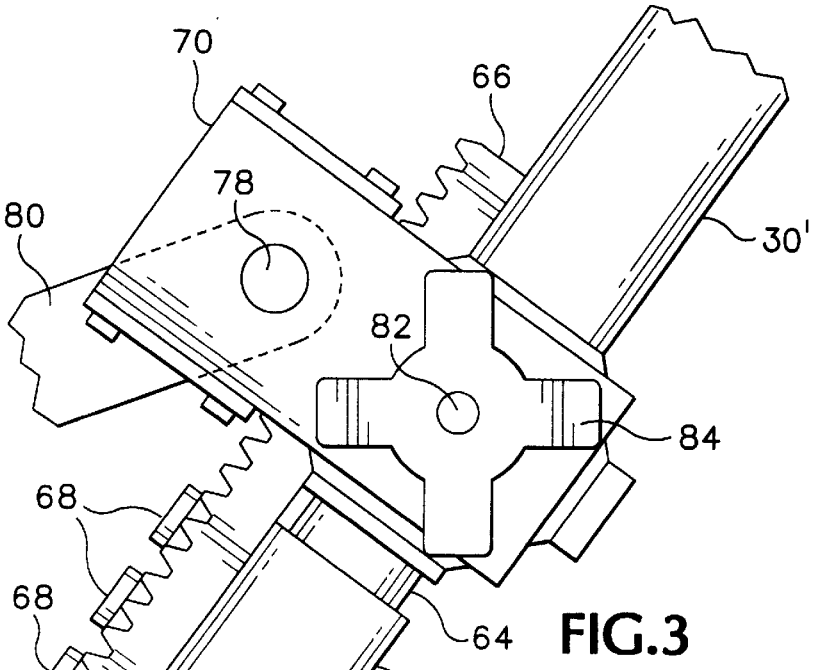
FIG. 3 is a fragmentary side elevation, on an enlarged scale, of the operating mechanism for the adjustable tripod leg shown in FIG. 2.

FIG. 2 of the drawings shows the device adjusted to the position in which the rotational plane P of the wheels is horizontal, for delivery of the ball B on an initial horizontal line. Adjustment of the trajectory of a ball in order to have the ball arrive at the batter's plate at various elevations relative to the strike zone, is accomplished by rotating knob 54 to loosen the clamping pressure on the pivot ball 16, and then moving the cross bar 56 manually to change the trajectory as desired. This manual adjustment is not sufficiently precise to produce the desired accuracy and reproducibility of ball pitches.

Figure 4:
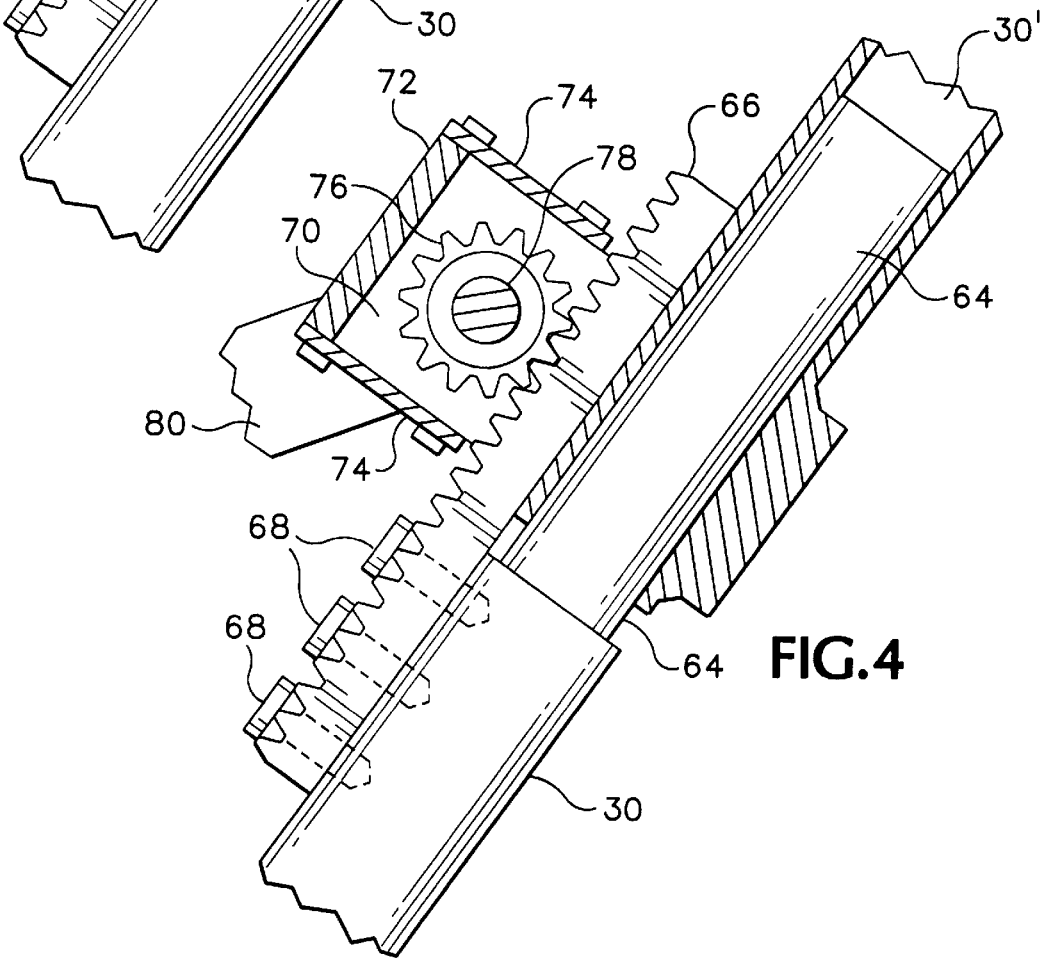
FIG. 4 is a fragmentary side elevation similar to FIG. 3 with parts broken away to disclose internal structural details.

It is the purpose of this invention to provide the precision and reproducibility of ball pitches that is required for effective batting practice. To this end, the rearward facing leg 30 (FIG. 2) is rendered adjustable in length precisely over a predetermined range. In the embodiment illustrated, the leg 30 is formed of two mutually extensible sections 30 and 30'. Leg section 30 is the longer of the two sections and is provided at its lower end with a cap 62 for engaging the ground. The other two tripod legs also are provided with similar caps. The opposite end of leg section 30 is provided with a shaft 64 (FIG. 4) which extends beyond the end of the leg section. An elongated toothed rack 66 is secured to leg section 30, as by screws 68, and projects beyond the end of the leg section, parallel to shaft 64.

Leg section 30' is a short length of metal tubing configured at one end for releasable attachment to the base support 20 by clamp member 28. The opposite end of leg section 30' mounts a housing 70 of U-shape formed integral with or otherwise secured to the leg section 30'. The open end of the housing is closed removably by end wall 72 and side walls 74.

A pinion gear 76 is contained within the housing 70 adjacent the walls 72 and 74 and is supported on a pinion shaft 78 mounted on the housing 70. The pinion gear meshes with rack 66. The shaft 78 extends outwardly of the housing and mounts a crank handle 80 by which the pinion gear is turned manually. A setscrew 82 extends through a threaded opening in a side of the housing for releasably engaging shaft 64 to secure the adjusted position of extension of the leg assembly 30, 30'. A knob 84 on the setscrew facilitates its manipulation.

In the operation of the ball throwing machine described hereinbefore, when it is desired to make an incremental change in the trajectory of a thrown ball, the setscrew 82 is loosened and the crank handle 80 is rotated in the approrpriate direction to lengthen or shorten the leg assembly 30, 30' to the extent necessary to achieve the desired change in elevation of the thrown ball as it crosses the batter's plate. The setscrew 82 then is tightened to secure the adjustment.

It will be apparent to those skilled in the art that various changes may be made in the size, shape, type, number and arrangement of parts described hereinbefore. For example, the mounting of the rack and pinion on leg sections 30 and 30' may be reversed. Although it is preferred that the adjustable leg 30, 30' be positioned rearwardly of the other two legs 32 and 34 to extend downwardly in the rearward direction and parallel to the line of flight of a thrown ball, the adjustable leg may be positioned forwardly of the other two legs to extend downwardly in the forward direction. The adjustable leg 30, 30' may be rotated on its longitudinal axis to position the crank handle 80 to the right of the leg or to any other angle desired. The setscrew 82 may be mounted in housing 70 to extend therefrom in any selected direction. The rack and pinion may be replaced with an extensible screw or hydraulic jack system. These and other changes may be made, as desired, without departing from the spirit of this invention and the scope of the appended claims.

We claim:

1. A ball throwing machine having a tripod leg support arranged with one leg disposed in substantial alignment with the direction of flight of a ball thrown by the machine, said one leg comprising a pair of telescopic sections for varying the length of the leg, and adjustment means interengaging said leg sections for changing the length of said one leg.

2. The ball throwing machine of claim 1 wherein said adjustment means comprises an elongated rack secured to one of said telescopic sections, a pinion gear mounted on the other of said telescopic sections and engaging said rack, and operator means engaging said pinion gear for rotating said gear to change the length of the said one leg.

3. The ball throwing machine of claim 2 wherein said operator means comprises a crank connected to the pinion gear for rotating said gear.

4. The ball throwing machine of claim 1 wherein the leg sections are hollow tubes, a shaft is secured within one leg section and projects therefrom for sliding engagment within the other leg section for coupling said leg sections together for longitudinal movement for varying the length of said one leg.

5. The ball throwing machine of claim 4 including a setscrew mounted on the leg section which slidably receives said shaft, the setscrew being movable between the retracted position disengaged from said shaft and an operative position engaging and securing said shaft.

* * * * *